US005323598A

United States Patent [19]

Stahlecker et al.

[11] Patent Number: 5,323,598

[45] Date of Patent: Jun. 28, 1994

[54] PROCESS FOR WITHDRAWING SLIVER FROM A CAN AND GUIDING THE SLIVER TO A SPINNNING MACHINE FOR SPINNING THE SLIVERS INTO YARN

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 799,130

[22] Filed: Nov. 27, 1991

[30] Foreign Application Priority Data

Nov. 30, 1990 [DE] Fed. Rep. of Germany ..... 4038231

[51] Int. Cl.[5] ..... D01H 5/26; D01H 5/86

[52] U.S. Cl. ..... 57/315; 57/59; 57/75; 57/90

[58] Field of Search ..... 57/59, 75, 90, 281, 57/315

[56] References Cited

U.S. PATENT DOCUMENTS

| | | | |
|---|---|---|---|
| 2,736,162 | 2/1956 | Steinberger | 57/90 X |
| 2,886,939 | 5/1959 | Wilks | 57/59 |
| 3,016,679 | 1/1962 | Rakhorst | 57/315 |
| 3,191,375 | 6/1965 | Naegeli | 57/315 X |
| 3,469,385 | 9/1969 | Tsuzuki | 57/315 X |
| 3,502,197 | 3/1970 | Fess et al. | 57/315 |
| 3,778,995 | 12/1973 | Sanders | 57/315 |
| 3,816,991 | 6/1974 | Takeuchi et al. | 57/352 X |
| 4,901,517 | 2/1990 | Fisher | 57/315 |

FOREIGN PATENT DOCUMENTS

| | | |
|---|---|---|
| 0041484 | 11/1985 | European Pat. Off. . |
| 0168357 | 4/1988 | European Pat. Off. . |
| 817572 | 10/1951 | Fed. Rep. of Germany . |
| 882068 | 7/1953 | Fed. Rep. of Germany . |
| 1510232 | 11/1974 | Fed. Rep. of Germany . |
| 2335740 | 2/1979 | Fed. Rep. of Germany . |
| 2934830 | 3/1981 | Fed. Rep. of Germany . |

OTHER PUBLICATIONS

3-Page German Search Report.

V. Grossman, O.: Der Stand des Kannenspinnverfahrens, In: Sonderdruck aus VDI-Berichte, Bd. 22, 1957, S. 27/38.

*Primary Examiner*—Daniel P. Stodola

*Assistant Examiner*—William Stryjewski

[57] ABSTRACT

In the case of a spinning machine whose spinning stations spin slivers which are withdrawn from cans, it is provided that the cans during the withdrawal rotate about their axis so that the slivers are provided with a true twist during the withdrawal.

3 Claims, 5 Drawing Sheets

PROCESS FOR WITHDRAWING SLIVER FROM A CAN AND GUIDING THE SLIVER TO A SPINNNING MACHINE FOR SPINNING THE SLIVERS INTO YARN

BACKGROUND AND SUMMARY OF THE INVENTION

This invention relates to a process and apparatus for the spinning of slivers by means of a ring spinning machine which has a plurality of spinning stations. One sliver respectively which is taken out of a can is fed to the drafting units of the spinning stations.

In the case of fast-running high-production spinning machines, it is customary to feed the fiber material to be spun in the form of slivers deposited in cans. This applies to open-end rotor spinning machines, open-end friction spinning machines, wind-around spinning machines and air spinning machines. The feeding in cans is also known for ring spinning machines, whereby a preceding machine, specifically the flyer spinning frame, is to be saved.

It is an object of the invention to provide a process by which the spinning operation of the individual spinning stations is improved and the costs for manufacturing a yarn are reduced.

This object is achieved according to preferred embodiments of the invention in that the slivers have a size of approximately Nm 0.25 to approximately Nm 0.8 and are guided by means of sliver guiding devices on the path from above the cans to the drafting units which are constructed as three-cylinder drafting units.

By means of this process, the advantage is achieved that finer sliver can be fed to the individual spinning stations, in which case these finer slivers can also be fed along a relatively long length. The spinning of finer slivers has the advantage that finer yarns of a good quality can be spun at the individual spinning stations with lower technical and mechanical expenditures.

In the case of ring spinning machines, the feeding of fine slivers permits an elimination of the preceding flyer spinning frame; that is, the direct spinning of slivers produced on a drafting frame is possible by means of the ring spinning machine. Nevertheless, no complicated drafting units are required for the ring spinning machine. On the contrary, the conventional and proven three-cylinder drafting units will be sufficient.

Relatively old proposals are known by means of which it was attempted to feed a sliver, which comes directly from a drafting frame, in cans to the ring spinning machines so that the flyer spinning frame which customarily precedes ring spinning machines may be eliminated. In this case, it is known (German Patent Document DE-PS 817 572) to set up the cans in two rows in an elevated manner between the two machines sides which are equipped with the drafting units. Each of these cans must contain at least four drawing frame slivers. It is also known (German Patent Document DE-PS 882 068) to deposit the cans on carriages which are set up above or below the spinning machine on intermediate floors, a special platform or a trolley. On the basis of such suggestions, practical tests were carried out in the Fifties which failed, however. On the one hand, the sliver had to be guided along relatively long paths which caused unintentional and uncontrolled drafts in the slivers so that the produced yarns did not have a satisfactory quality. Furthermore, drafting units had to be created which permit a very high draft on the one hand, but, on the other hand, nevertheless have only a relatively low delivery speed. This had the result that the draw-in rollers of such drafting units run at very low rotational speeds, that is, at 2 $min^{-1}$ (revolutions per minute) or less. Such rotational speeds can hardly be controlled in the case of drafting units for ring spinning machines which have a considerable length. The draw-in rollers therefore moved jerkily and, because of torsional effects, also at different speeds in the area of the machine end so that additional wrong drafts were caused. These tests were therefore given up in the case of ring spinning machines. Even today, a flyer spinning frame still precedes the ring spinning machine and produces roving bobbins, the roving of which is so fine that it can be processed by three-cylinder drafting units without any difficulty. In this case, it is known to provide the roving withdrawn from the roving bobbins with a false twist before it enters into the drafting units. In one case (European Patent Document EO-0 041 484 B1), the roving is guided over a stationary false-twisting element. In the case of another solution (European Patent Document EP-0 168 357 B1), a special construction of a drafting unit is provided which rotates about the yarn axis. In addition, a suggestion has become known (German Patent Document DE 29 34 830 A1) that, when the slivers produced on a drafting frame are deposited in cans, these slivers are provided with a protective twist by false twisting. However, this arrangement has not been accepted in practice because it was probably overlooked that the false twist opens up downstream of the twist generating devices so that in fact the sliver is not provided with any protective twist.

In the case of wind-around spinning machines, such as the Süssen-Parafil, or in the case of air spinning machines, such as the Süssen-Plyfil, it is known to provide slivers in cans. In these cases, the slivers have relatively coarse sizes so that they withstand the transport from the cans to the drafting unit without any wrong drafts. The drafting units must have a very high draft so that here also the expensive five-cylinder drafting units are provided. The functioning of these expensive drafting units is possible because the spinning in this case takes place at high delivery speeds so that the draw-in rollers rotate at sufficient rotational speeds. By using finer slivers, it becomes possible in the case of these machines to do without the expensive five-cylinder drafting units and to replace them by three-cylinder drafting units which have shown good results in the case of ring spinning machines and which, in addition, are easier to operate.

In a further development of the invention, it is provided that the slivers receive a twist of from 2 to 15 T/m (twists per meter). Since the draw-in speeds of the slivers, also in the case of fast-running spinning machines, such as open-end rotor spinning machines, seldom exceed 1 m/min, the cans must rotate only at relatively low rotational speeds so that they can be driven by simple drives and do not require any excessive technical expenditures and therefore do not cause any excessive costs. The introduced twists, in addition, must not maintain an exact value that remains constant and must also not be distributed absolutely uniformly since the twist is largely or completely opened up again by a drafting or separating of the fibers.

In a further development of the invention, devices for rotating the cans around their axes are provided in the case of spinning machines with several spinning stations for the spinning of yarns from slivers which are withdrawn from cans by devices which are part of the spinning stations. As a result, the slivers are provided with a true twist during the withdrawal so that fine slivers can be processed without the danger of wrong drafts and in this case can also be fed to the individual spinning stations along relatively long paths.

In a further development of the invention, it is provided that the devices for the rotating and the devices for the receiving of the cans, which can be set up in several rows extending in the longitudinal direction of the machine, are arranged above the pertaining spinning machine. This ensures that the space requirement is not increased in comparison to conventional machines with respect to the required area which is particularly significant in the case of ring spinning machines in which the individual spinning stations are arranged on both sides of the machine at a relatively narrow spacing.

In a further development of the invention, it is provided that the devices for the rotating of the cans are assigned to the bottoms of the cans. As a result, it is possible to simply deposit the cans on the devices for the rotating so that the feeding of full cans and the moving-away of empty cans presents no problems. In addition, such devices for the rotating, which are assigned to the bottoms of the cans, require no new can shapes.

In a further development of the invention, it is provided that the devices for the rotating of the cans are arranged in a line-up platform for the cans on which the cans can be deposited in at least two rows extending in the longitudinal direction of the machine. This line-up platform may, for example, in the case of open-end spinning machines, be arranged essentially in front of and under the spinning stations. In the case of one-sided machines, such as the Süssen-Parafil wind-around spinning machine or the Süssen-Plyfil air spinning machine, such a line-up platform may be arranged behind the spinning units, that is, on the side facing away from the operating side.

In the case of ring spinning machines or machines with a similarly narrow spindle gauge, it is expediently provided in another development of the invention that the line-up platform is constructed as an accessible platform. This platform will expediently exhibit a height which is sufficient for leaving an operating aisle for operators and for movable servicing apparatuses.

In a further development of the invention, it is provided that the devices for the rotating comprise rotatably disposed plates which are assigned to one can respectively and which are connected to a rotary drive.

In another embodiment of the invention, an endless driving element is provided as the device for the rotating which extends in parallel to the longitudinal direction of the machine and on which several cans are deposited which are arranged in a row. In this case, it is expedient for devices for fixing the cans in their position to be assigned to the cans. Such driving elements, which may be belts, bands or coated cords, can be implemented very easily.

In a further development of the invention, it is provided that a deflecting device for the slivers is arranged above the cans. This deflecting device provides that, in a known manner, the slivers are withdrawn from the cans essentially upwards. In addition, this deflecting device is also used as a twist stopping device so that the twist introduced by the rotating of the cans is introduced into the slivers in a defined area. In an expedient further development, it is provided that the deflecting device comprises a withdrawal roller pair with at least one drivable withdrawal roller.

In a further development of the invention, it is provided that sliver guiding devices follow the deflecting device which each lead to one spinning station. These sliver guiding devices provide that the slivers move on a defined path. In this case, it is advantageous for guiding tubes to be provided as the sliver guiding devices in a further development. The slivers can relatively easily be sucked or blown into these guiding tubes so that the initial application of the cans to the spinning stations can be carried out relatively easily.

Other objects, advantages and novel features of the present invention will become apparent from the following detailed description of the invention when considered in conjunction with the accompanying drawings.

DETAILED DESCRIPTION OF THE DRAWINGS

Figure 1:
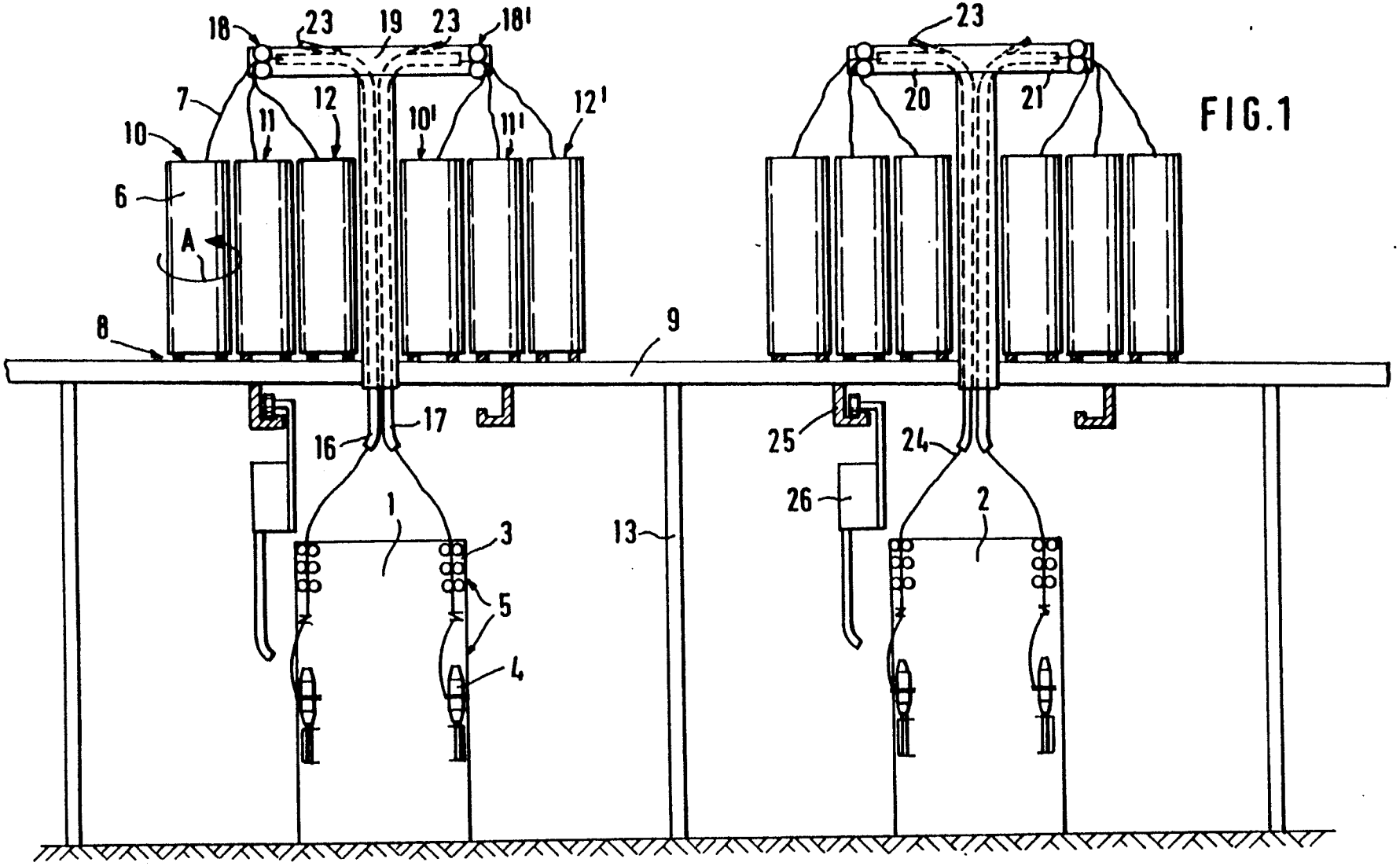
FIG. 1 is a partial schematic view of a system comprising several ring spinning machines, to the spinning stations of which slivers are fed which are each produced on a drafting frame and which are fed in rotating cans arranged on a platform, constructed according to a preferred embodiment of the present invention.

The complete system illustrated in FIG. 1 comprises a plurality of ring spinning machines of which two ring spinning machines 1 and 2 are shown very schematically in FIG. 1. Each of these ring spinning machines 1, 2, on both sides, comprises a plurality of spinning stations 5 which are constructed in a generally known manner. Spinning stations 5 each comprise a drafting unit 3 and a spindle 4 as well as the customary yarn guiding and driving elements. Ring spinning machines 1, 2 of this type comprise a large number of spinning stations 5, for example, 500 on each side of the machine. A can 6 is assigned to each spinning station 5, and a sliver 7, a so-called drawing frame sliver, is withdrawn from this can 6 and is fed to the drafting units 3. The cans 6, which can be commercially available cans with a diameter of nine inches, are arranged for each of the ring spinning machines 1, 2 in six rows 10, 11, 12; 10', 11', 12' extending in the longitudinal direction of the machine, in which case three rows 10, 11, 12; 10', 11', 12' are assigned to one side of the machine. The cans 6 are arranged on a line-up platform 9 which has rotary drives 8 for the cans 6 by means of which the cans 6 are rotated in the direction of the arrow (A).

The slivers 7 are withdrawn from the cans 6 by way of deflecting devices 18, 18' which are arranged above the cans 6. The deflecting devices 18, 18' may be formed by one or two rollers which are disposed in a freely rotatable manner. They may also be formed by a drivable roller extending through in the longitudinal direction of the machine and individual pressure rollers. The deflecting devices 18, 18' are followed by guiding tubes 16, 17 for each of the slivers 7 which first extend horizontally with respect to the machine center and then downward in the direction of the drafting units 3 through the line-up platform 9. Since the otherwise customary creels do not exist in the case of the ring spinning machines 1, 2, the platform 9 may be kept relatively low; that is, just high enough so that sufficient space is ensured for the operator's head. The platform 9 is supported toward the floor by means of several uniformly distributed supports 13. In the case of the shown embodiment, the platform 9 is equipped with rails 25 on its underside on which servicing devices, such as travelling blowers 26, can be moved.

It is endeavored to keep the slivers, which are produced in a drafting frame and deposited in the cans 6, as fine as possible, that is, of a yarn size of Nm 0.3 or less, particularly between Nm 0.3 and Nm 0.8. Such fine slivers 7 can then be processed directly by the ring spinning machine 1, 2 without having to provide particularly expensive drafting units 3. Three-cylinder drafting units 3, which permit up to 170-fold drafts, may then easily be used. Because of the rotation of the cans in the direction of the arrow (A), the slivers 7 obtain a true twist. The area, in which this true twist is introduced, is limited to the area between the cans 6 and the deflecting devices 18. In practice, 2 to 15 T/m (twists per meter) are sufficient. Since the withdrawal speeds for the slivers 7 are relatively low, rotational speeds of from 2 $min^{-1}$ to 10 $min^{-1}$ for the cans 6 are sufficient for achieving this rotation. As a result of the true twist, the slivers 7 obtain a sufficient strength in order to span the length from the deflecting devices 18, 18' to the drafting units 3 without the risk of wrong drafts or even sliver breakages. In addition, the relatively slow rotation of the slivers has an advantageous effect on the uniformity of the drafting in the drafting units 3. In order to be able to feed the slivers 7 to the drafting units 3 during a piecing, the guiding tubes 16, 17 are equipped with injector nozzles 23 to which a compressed-air pistol or the like can be connected in order to convey the slivers 7 to the mouths 24 of the guiding tubes 16, 17.

The machine width of the ring spinning machines 1, 2 corresponds to the machine width which is customary today. However, because of the use of cans 6, it may be necessary to increase the distance between the cans 1, 2 slightly in comparison to the measurement which is customary today. It is, however, also possible to arrange the cans 6 in two tiers above one another if the height of the available space allows it. The slivers 7, which are provided with a true twist, also easily allow a transport along a major height without the risk that the slivers 7 may "hang out", that is, may be drawn in an uncontrolled manner, during a machine stoppage. In this case, it is also possible to change to larger cans 6 without having to enlarge the spacing of the ring-spinning machine 1, 2, that is, the spacing of the spinning stations 5 with respect to one another in the longitudinal direction of the machine.

As mentioned above, the cans 6 rotate about their axes at relatively low rotational speeds. Since the true twist introduced into the slivers 7 is only a protective twist which is largely opened up again by the drafting in the drafting units 3, no high requirements exist concerning a precise observing of the rotations with respect to rotational speed or distribution. It is therefore possible to provide relatively simple and inexpensive driving devices 8 for the cans 6. The costs for the line-up platform 9 and the driving devices 8 as well as the other additional constructions must naturally not be higher than the cost of the eliminated flyer spinning frame and the previous creel of the ring spinning machines 1, 2 in which roving bobbins are suspended. Naturally, it should be endeavored that the costs for the line-up platform 9 and the rotary drives 8 and the additional cans 6 are clearly lower than the costs of the flyer spinning frame. In addition, by means of the spinning of the slivers 7 produced by the drafting frames from the cans 6, another advantage is achieved because the automatic connecting between the flyer spinning frame and the ring spinning machine endeavored nowadays in practice is eliminated by means of which an automatic exchange of the roving bobbins with a delivery and removal of the roving bobbins is endeavored.

As mentioned above, the requirements concerning the precision of the rotary drives are not exceedingly high so that inexpensive constructions can be used for this purpose. Examples of such inexpensive constructions are shown in FIGS. 2 to 9 which are described in the following.

Figure 2:
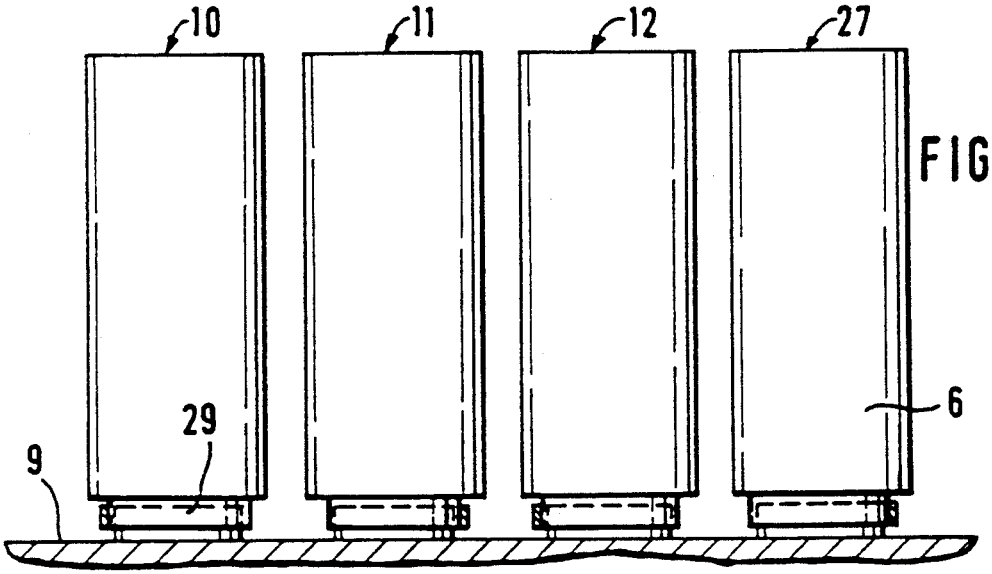
FIG. 2 is a partial sectional view of a line-up platform for cans set up in several rows, where, in each case, drivable plates are provided for the setting-up of the cans.
Figure 3:
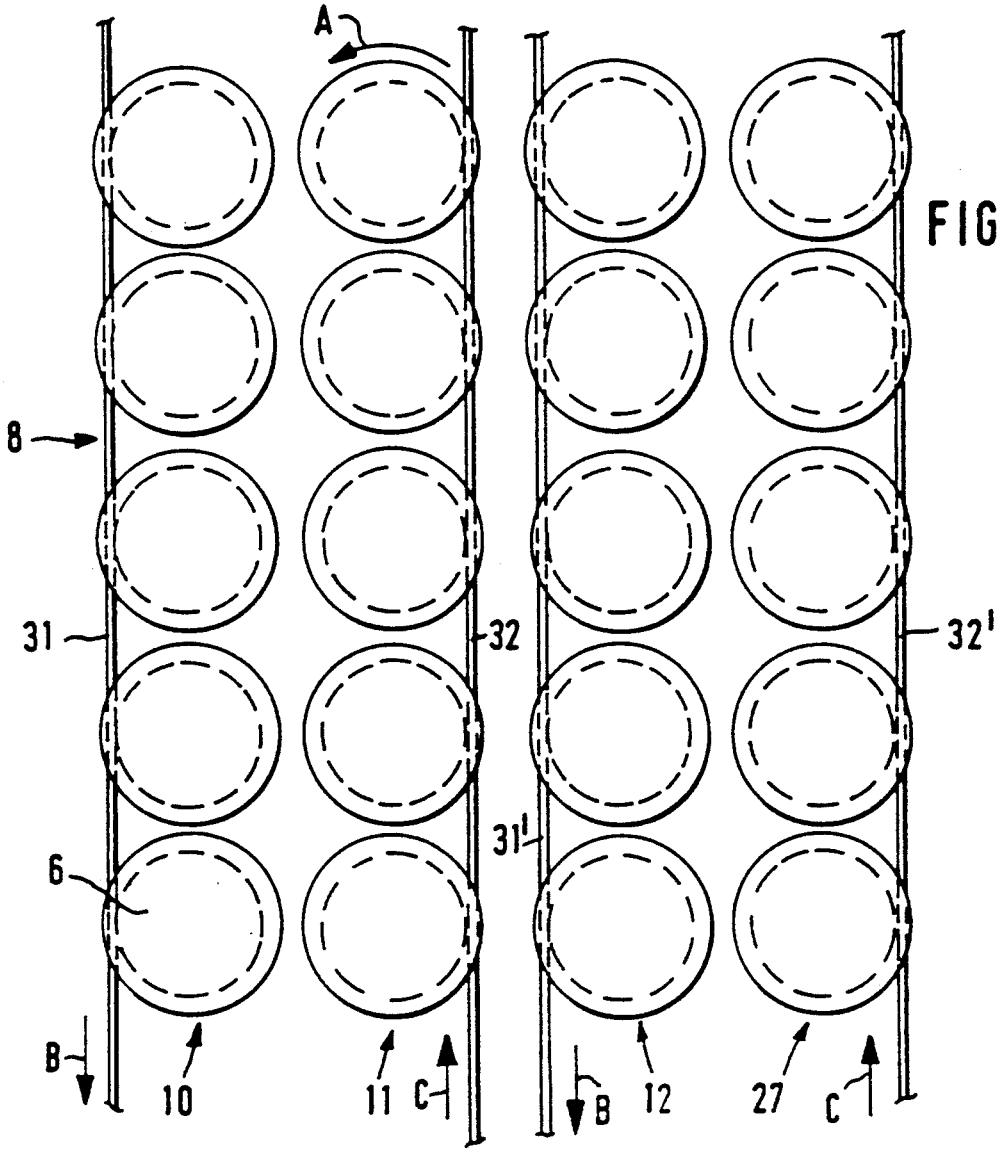
FIG. 3 is a top view of the embodiment according to FIG. 2.

In the case of the embodiment according to FIGS. 2 and 3, the cans 6, which in this embodiment are set up in four rows 10, 11, 12; 27, stand on plates 29 with their bottoms. The plates 29 have a diameter which is slightly smaller than the diameter of the cans 6. The bottoms of the cans 6 are normally set back with respect to a lower edge bead which extends as an extension of the side walls so that the cans 6 are centered on the plates 29. The drive of the cans 6 takes place by way of flat belts which extend upright with their two ends or belt runs 31, 32 and 31', 32'travelling in the direction of the arrows (B and C) in the longitudinal direction of the machine. A flat belt with the runs 31, 32 or 31', 32' therefore drives two rows 10, 11; 12, 27 of cans 6. The runs 31, 32; 31', 32' extend as tangential belts along the plates 29 of the rows 10, 11; 12, 27. In the case of a first embodiment, it is provided that they drive the rotatably disposed plates 29 which then in turn take along the cans 6. In the case of a deviating embodiment, it is provided that the plates 29 are arranged non-rotatably and form a sliding surface with respect to the runs 31, 32; 31', 32' which project upward beyond the plates 29 and thus are in contact with the lower edge of the cans 6. In this case, the runs 31, 32; 31', 32' drive the cans 6 directly. In the case of this version, it will then expediently be provided that the plates 29 or the line-up platform 9 are provided with guiding elements which support the runs 31, 32; 31', 32' in the vertical direction.

As a deviation from the representation according to FIG. 2, in which the surface of the line-up platform 9 is situated below the plates 29 and the belt runs 31, 32; 31' 32', it may also be provided that the top side of the platform is situated higher and, in particular, closes off flush with the top sides of the plates 29. In this case, recesses are provided in the line-up platform 9 in the area of the plates 29 which are slightly larger than the diameters of the cans 6.

Figure 4:
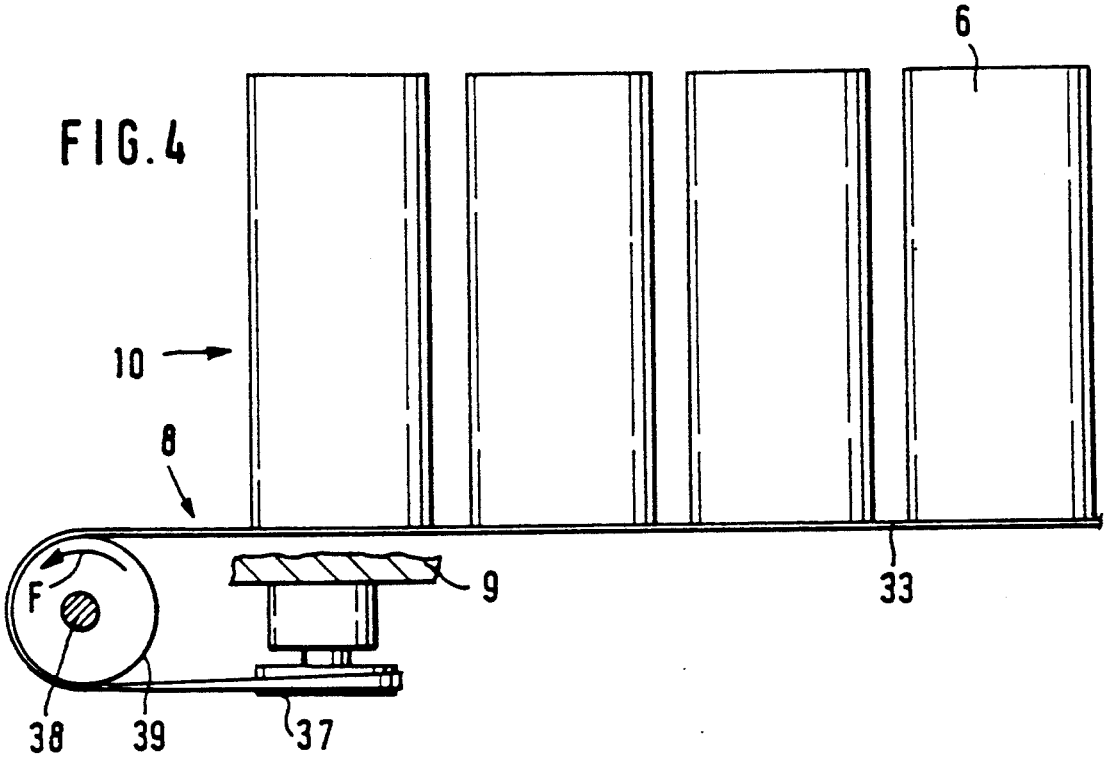
FIG. 4 is a partial longitudinal sectional view of the devices for the rotating of cans which have a flat belt which travels with its two ends in the longitudinal direction of the machine and on which the cans are deposited.
Figure 5:
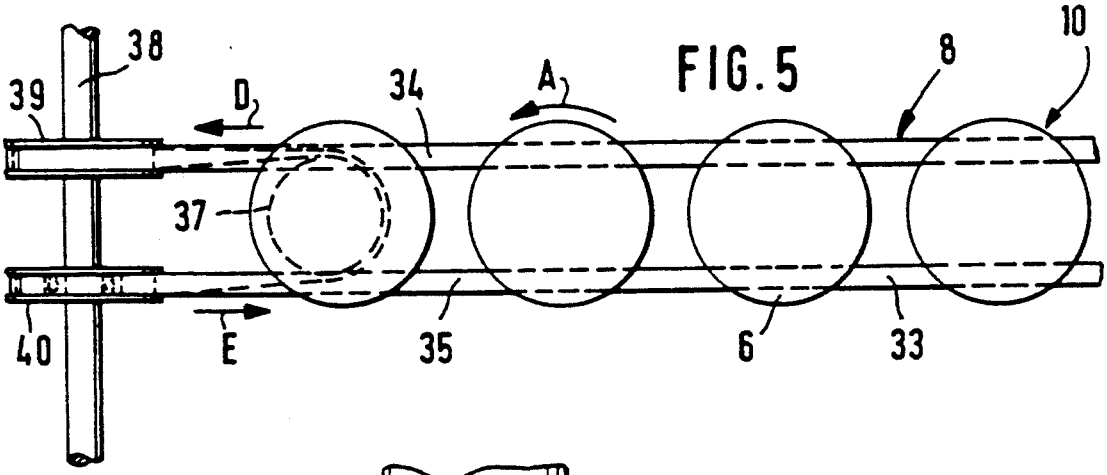
FIG. 5 is a top view of the embodiment according to FIG. 4.
Figure 6:
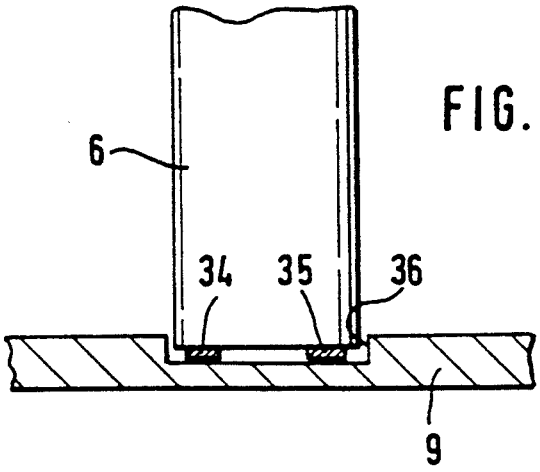
FIG. 6 is a cross-sectional view of the line-up platform according to FIGS. 4 and 5.

In the embodiment according to FIGS. 4 to 6, one drive 8 is guided for each row 10 of cans 6 by means of one belt 33 respectively, the two runs 34, 35 of which extend in a flat position in the longitudinal direction of the machine and have such a distance from one another that they extend in the form of secants under the bottoms of the cans 6. The cans 6 are set up in recesses 36 of the line-up platform 9 directly on the runs 34, 35 of the belt 33. The recesses 36 may extend through in the form of grooves in the longitudinal direction of the machine, in which case transverse webs are arranged between the cans 6 which permit a passage for the runs 34, 35. However, it is also possible to provide in each case round recesses 36 for the individual cans 6, in which case passage possibilities for the belt runs 34, 35 are also provided.

In the embodiment according to FIGS. 4 to 6, a separate belt 33 is provided for each row 10, 11, 12 . . . , in which case, however, a joint drive is provided for these belts 33 of several rows. This drive comprises a drivable shaft 38, which is mounted on the machine end and on which a driving wheel 39 is arranged around which the belt 33 is wound. Under the line-up platform 9, a deflecting wheel 37 is arranged which has a vertical axis of rotation so that the belt 33 is rotated by 90°. The belt 33 is then guided by way of another deflecting wheel 40 arranged freely rotatably on the shaft 38. On the opposite machine, which is not shown,, a similar guiding of the belt is arranged with a shaft and two deflecting rollers which are freely rotatably arranged on it and a third deflecting roller with a vertical axis.

Figure 7:
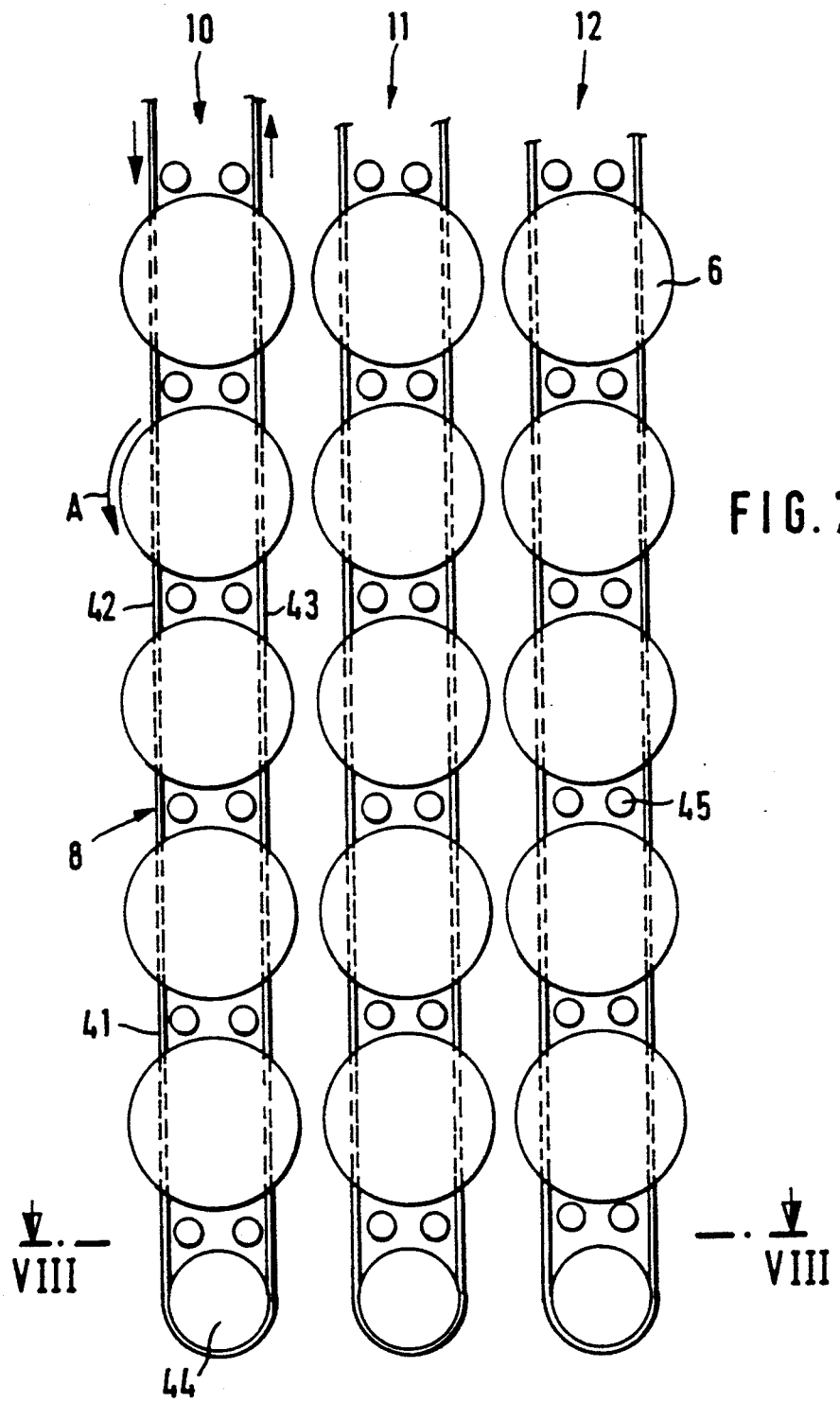
FIG. 7 is a top view of an embodiment in which the cans travel on ends of upright flat belts extending in the longitudinal direction of the machine.
Figure 8:
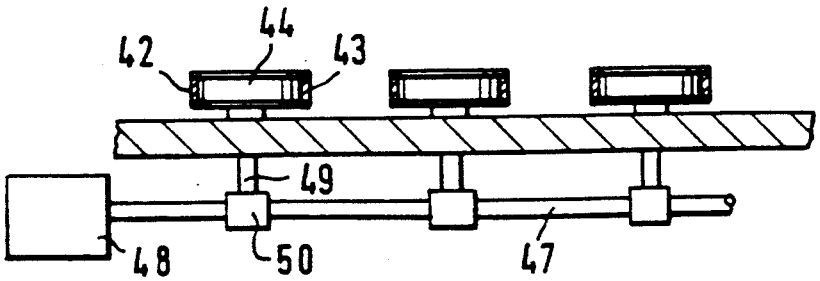
FIG. 8 is a sectional view along Line VIII—VIII of FIG. 7.

In the embodiment according to FIG. 7 and 8, a separate belt 41 is also provided as a drive 8 for each row 10, 11, 12 of cans 6 which is constructed as a flat belt and with its two belt runs 42, 43, extends underneath the cans 6 of one row 10, 11, 12 respectively such that the cans 6 stand with their lower edge on the narrow sides of the belt runs 42, 43. As a result, a simplified drive is obtained for the belt 41 which, on one machine end, has a driving disk 44 with a vertical axis of rotation and, on the other end, has a corresponding deflecting disk which is not shown. The driving disks 44 are driven by way of V-drives 49, 50 by a joint driving motor 48 by means of a shaft 47.

In the embodiment according to FIGS. 7 and 8, the belt runs 42, 43 of the flat belts 41 are guided in groove-shaped guides of the line-up platform 9. These groove-shaped guides, which are expediently provided with a sliding coating or are equipped at given distances with sliding guides or guide pulleys, are expediently arranged sunk with respect to the top side of the line-up platform 9 such that the belt runs 42, 43 project out of the top side of the platform only with a relatively low height. In the platform, guide pulleys 45 are also provided which are arranged in pairs between the cans 6 of one row and which have the purpose of centering the cans 6 in the desired position in the rows 10, 11, 12.

Figure 9:
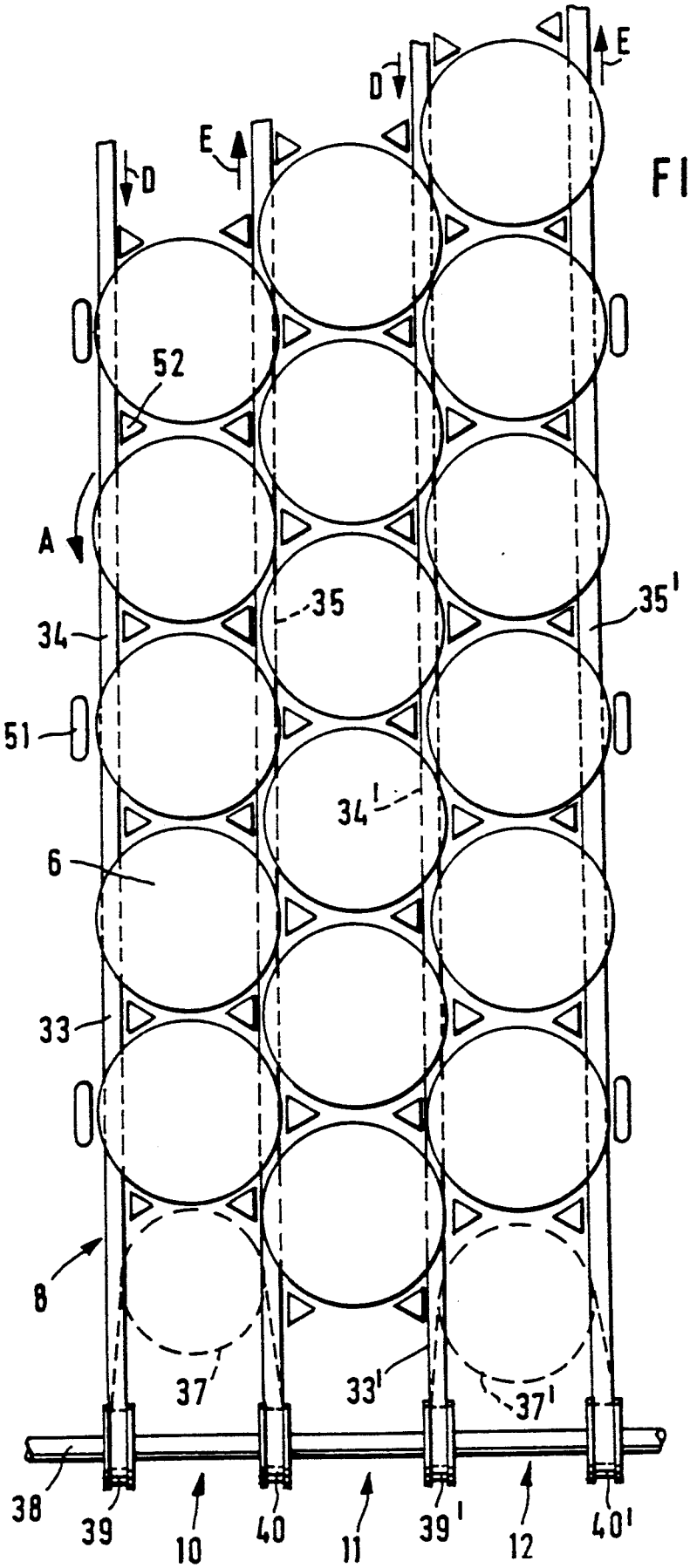
FIG. 9 is a top view of devices for the rotating of cans which are set up in three rows which are arranged offset with respect to one another.

The embodiment according to FIG. 9 has a drive for the cans 6 which corresponds to the embodiment according to FIGS. 4 and 5. However, in this embodiment, the rows 10, 11, 12 of the cans 6 are arranged offset with respect to one another so that the cans 6 of the rows 10, 11, 12 are in each case staggered with respect to one another to fill gaps. As a result, it is possible to drive three rows 10, 11, 12 of cans 6 by means of two belts 33, 33'. One end 35, 34' of the belts 33, 33' respectively extends through under the bottoms of the two rows 10, 11; 11, 12 of cans 6. Although in this embodiment, the cans 6 of the center row 11 are driven in the opposite direction of the cans 6 of the two outer rows 10, 11, this is insignificant because the true twist which is provided to the slivers 7 by the rotating of the cans 6 is opened up again in the drafting units 3 because of the draft.

As illustrated in FIG. 9, guide blocks 51, 52 are arranged in the line-up platform 9 on both sides of the belt runs 34, 35; 34', 35' and are used as the lateral guide for the belt runs 34, 35; 34', 35'. Expediently, it is provided that these guide blocks 51, 52 project so far away from the top side of the line-up platform which is not shown that they are also used for the centering of the cans 6. In this case, the guide blocks 52, which are arranged in the spacing between the cans 6, are adapted to these spacing; that is, in the top view, they have an essentially triangular contour.

The drives 8 for the cans 6, which are explained by means of FIGS. 2 to 9, may also have other belt forms instead of the flat belts, for example, round belts, or the like. In particular, it is also contemplated to provide cords as drives, particularly wire cords, which are then expediently provided with a plastic coating. In particular, in the case of round belts or cords, the guiding and driving devices can be simplified.

Although the invention has been described and illustrated in detail, it is to be clearly understood that the same is by way of illustration and example, and is not to be taken by way of limitation. The spirit and scope of the present invention are to be limited only by the terms of the appended claims. scope of the present invention are to be limited only by the terms of the appended claims.

What is claimed:

1. A process for spinning slivers into yarn at a spinning machine having a plurality of ring spinning stations, comprising:

withdrawing sliver from a can in an upward direction and guiding the sliver between the can and a drafting unit at a ring spinning unit via a sliver guiding device that is independent of the can and includes at least one drivable roller, ring spinning the sliver at a ring spinning unit to a fineness of at least Nm 40, drafting the sliver in the drafting unit at least 170-fold, wherein the slivers have a size of between approximately Nm 0.25 and approximately Nm 0.8, and wherein the drafting unit is a three cylinder drafting unit.

2. A process according to claim 1, further comprising providing the sliver with a twist of between 2 twists/meter (t/m) to 15 t/m during the sliver travel from the can to the drafting unit.

3. A process according to claim 2, wherein aid providing the sliver with a twist includes rotating the can as sliver is being fed therefrom.

* * * * *